US006260790B1

(12) United States Patent
Harrah

(10) Patent No.: US 6,260,790 B1
(45) Date of Patent: Jul. 17, 2001

(54) COILED PIPE DISPENSING RACK

(76) Inventor: Kelly T. Harrah, 115 W. Liberty St., Coshocton, OH (US) 43812

( * ) Notice: Subject to any disclaimer, the term of this patent is extended or adjusted under 35 U.S.C. 154(b) by 0 days.

(21) Appl. No.: 09/471,673

(22) Filed: Dec. 24, 1999

(51) Int. Cl.[7] ..... B65H 16/02

(52) U.S. Cl. ..... 242/557; 242/403; 242/604; 242/608.3

(58) Field of Search ..... 242/557, 597.2, 242/597.6, 403, 407.1, 604, 608.3

(56) References Cited

U.S. PATENT DOCUMENTS

| | | | | |
|---|---|---|---|---|
| 565,054 | * | 8/1896 | Trembly | 242/403 |
| 1,480,769 | * | 1/1924 | Leber | 242/604 |
| 2,370,868 | * | 3/1945 | Luebke | 242/407.1 |
| 2,914,270 | * | 11/1959 | Parker et al. | 242/403 |
| 3,263,940 | | 8/1966 | Wright et al. . | |
| 3,326,495 | | 6/1967 | DeBruyn . | |
| 3,503,569 | | 3/1970 | Gildart . | |
| 3,976,260 | * | 8/1976 | Irik | 242/403 |
| 4,071,203 | | 1/1978 | Sneed et al. . | |
| 4,095,706 | * | 6/1978 | Schwien et al. | 242/557 |
| 4,148,445 | | 4/1979 | Reynolds et al. . | |
| 4,339,096 | * | 7/1982 | May | 242/557 |
| 4,345,724 | * | 8/1982 | Lindell | 242/608.3 |
| 4,422,596 | | 12/1983 | Cleavenger . | |
| 4,700,908 | | 10/1987 | Easter . | |
| 4,844,376 | | 7/1989 | Maraman . | |
| 4,949,909 | | 8/1990 | Hatfield . | |
| 5,158,243 | * | 10/1992 | Sigle et al. | 242/557 |
| 5,369,832 | | 12/1994 | Hagger . | |
| 5,476,234 | * | 12/1995 | St. Pirre | 242/557 |
| 5,582,216 | * | 12/1996 | Smith et al. | 242/557 |
| 5,588,628 | * | 12/1996 | Sachleben | 242/407.1 |
| 5,687,928 | * | 11/1997 | Lassiter | 242/557 |
| 5,890,754 | | 4/1999 | Murr . | |
| 5,954,294 | * | 9/1999 | Forsner | 242/604 |
| 6,065,716 | * | 5/2000 | Munster | 242/597.6 |

FOREIGN PATENT DOCUMENTS

| | | | | |
|---|---|---|---|---|
| 2855345 | * | 7/1980 | (DE) | 242/557 |

* cited by examiner

*Primary Examiner*—Emmanuel M. Marcelo
(74) *Attorney, Agent, or Firm*—Kremblas, Foster, Phillips & Pollick

(57) ABSTRACT

A coiled pipe dispensing rack for use in cooperation with a moving vehicle to effectuate the unrolling of plastic pipe, with the rack comprising a main cage, a hub and spindle assembly, and a mounting unit. The main cage comprises a first portion and a second portion which cooperate with each other to retain a coil of plastic pipe therebetween. Both the first and second portion each comprise a center plate, a plurality of strut arms, and an exterior side wall, with each of the strut arms connected to and radiating outwardly from the respective center plate, and with each of the strut arms connected to the respective exterior side wall. The hub and spindle assembly is positioned intermediate the main cage and the mounting unit. The mounting unit remains in contact with the moving vehicle as the pipe is unrolled.

15 Claims, 4 Drawing Sheets

COILED PIPE DISPENSING RACK

FIELD OF THE INVENTION

The present invention relates generally to pipe, and more particularly, to a device which is used to dispense plastic pipe from a coil. Although many types of pipe could be dispensed using the device of this invention, the device has special application for use with the type of pipe used in natural gas lines or pipelines.

BACKGROUND OF THE INVENTION

This invention is directed to the providing of a device for use in the laying of pipe, and more particularly for use in the laying of pipe of the type used in natural gas lines or pipelines, although it is recognized that the use of the device of this invention may also have application in the laying of other types of pipe, such as drainage pipe. When it came to the laying of plastic pipe for gas pipelines, originally this was done by manually unrolling the flexible plastic pipe from large coils. In order to grasp a better understanding of the magnitude of the task, it should be appreciated that a 500' long roll of pipe weighs about 350 pounds. Therefore, in actual practice four or five individuals were needed in order to control the coiled pipe as it was unrolled. This strenuous job was also very time consuming. For example, it might take 4½–5 hours to unroll a 500' long roll of pipe. Additionally, the coiled pipe was kept coiled and compact through the use of a plurality of retaining bands which when periodically cut, so as to effectuate the further unrolling of the pipe (typically 25' at a time between retaining bands), sometimes resulted in the pipe springing out uncontrollably, thereby injuring one or more of the workers standing nearby.

More recently, alternatives were developed for the dispensing of coiled plastic pipe. One such device is disclosed in U.S. Pat. No. 4,949,909 to Hatfield. The pipe coil dispensing rack disclosed in that patent provided a turntable atop a frame, such that the pipe could be unwound from the stationary device in cooperation with a moving pipe puller. One significant drawback associated with such a device is its stationary nature. In order to lay pipe using that embodiment of a dispensing rack, the pipe must be unrolled using a pipe puller, cut at or near the rack once the predetermined amount of pipe has been laid, and then a worker must return to and move such a rack to a new location where the installation process is repeated or else a worker must always remain with the rack. Although easier than the original procedure, this method still is fairly time consuming due to having a worker return over and over again to the dispensing rack in order to move it to its next location or else dedicating a worker to staying with the rack the entire time the pipe puller is in operation.

In the natural gas pipeline industry, the problem has been addressed by utilization of a pipe-coil trailer, which specially built unit is pulled by a truck. The trailer orients the coiled pipe horizontally and permits it to be unwound from the trailer as the trailer is pulled over the ground. However, these trailers typically still require 3 people to lift the heavy coil of pipe up into its horizontal position atop the trailer. Additionally, the terrain often limits the use and effectiveness of this alternative. Moreover, since it is common to have a two ton utility truck pull the pipe-coil trailer, this approach requires that a utility truck be dedicated for the pulling operation. Oftentimes, this is not possible due to the scheduling of the trucks, consequently resulting in the delay of the installation of the gas pipe.

It is thus apparent that the need exists for an improved pipe dispensing device for use with the type of coiled plastic pipe which is utilized in the gas pipeline industry.

SUMMARY OF THE INVENTION

In accordance with this invention there is disclosed a coiled pipe dispensing rack for use in cooperation with a moving vehicle to effectuate the unrolling of plastic pipe. The rack comprises a main cage, a hub and spindle assembly, and a mounting unit. The main cage comprises a first portion and a second portion which cooperate with each other to retain a coil of plastic pipe, while the mounting unit is in contact with the moving vehicle as the pipe is unrolled. The hub and spindle assembly is positioned intermediate the main cage and the mounting unit.

The main cage first portion comprises a center plate, a plurality of strut arms, and an exterior side wall, with each of the strut arms connected to and radiating outwardly from the center plate, and with each of the strut arms connected to the first portion's exterior side wall. There also are a plurality of coil supports, with each coil support being secured to a strut arm. The main cage first portion also includes a plurality of gussets, with each of the gussets being secured to a coil support and also to the center plate. At least one mounting pin is secured to the main cage first portion. The main cage second portion comprises a center plate, a plurality of strut arms, at least one locking plate, and an exterior side wall, with each of the strut arms connected to and radiating outwardly from the center plate, and with each of the strut arms connected to the main cage second portion's exterior side wall. Each aforementioned mounting pin is secured to the main cage first portion, as well as cooperating with a respective locking plate to retain a coil of plastic pipe between the first and second portions of the main cage.

The hub and spindle assembly includes a hub portion and a spindle portion, with the hub portion having a front wall which is in contact with the center plate. The spindle portion includes a connecting tube and a retaining plate, with the connecting tube engaging the mounting unit. The retaining plate cooperates with the mounting unit to secure the hub and spindle assembly to the mounting unit.

The mounting unit includes a pair of opposing side walls separated by a plurality of spacing bars. The mounting unit also has a connecting channel which engages the hub and spindle assembly. Additionally, the mounting unit has at least one retaining plate cooperating with the hub and spindle assembly to secure the mounting unit to the hub and spindle assembly.

There is also disclosed a coiled pipe dispensing rack for use in cooperation with a moving vehicle to effectuate the unrolling of plastic pipe, with the rack comprising a main cage, a hub and spindle assembly, and a mounting unit. The main cage comprises a first portion and a second portion which cooperate with each other to retain a coil of plastic pipe. The main cage first portion comprises a center plate, a plurality of strut arms, a plurality of coil supports, with each coil support being secured to a strut arm, a plurality of gussets, with each of the gussets being secured to a coil support and also to the center plate, at least one mounting pin secured to the main cage first portion, and an exterior side wall. Each of the strut arms are connected to and radiate outwardly from the center plate, and each of the strut arms are connected to the exterior side wall. The main cage second portion comprises a center plate, a plurality of strut arms, at least one locking plate, and an exterior side wall, with each of the strut arms connected to and radiating outwardly from the center plate, and with each of the strut arms connected to exterior side wall. Each mounting pin cooperates with a respective locking plate to retain a coil of plastic pipe between the first and second portions. The mounting unit is in contact with the moving vehicle as the pipe is unrolled, with the hub and spindle assembly positioned intermediate the main cage and the mounting unit.

The hub and spindle assembly includes a hub portion and a spindle portion, with the hub portion having a front wall, with that front wall being in contact with the center plate. The spindle portion comprises a connecting tube and a retaining plate, with the connecting tube engaging the mounting unit. The retaining plate cooperates with the mounting unit to secure the hub and spindle assembly to the mounting unit.

The mounting unit comprises a pair of opposing side walls separated by a plurality of spacing bars, a connecting channel to engage the hub and spindle assembly, and at least one retaining plate cooperating with the hub and spindle assembly to secure the mounting unit to hub and spindle assembly.

There is also disclosed a coiled pipe dispensing rack for use in cooperation with a moving vehicle to effectuate the unrolling of plastic pipe, with the rack comprising a main cage, a hub and spindle assembly, and a mounting unit. The main cage comprises a first portion and a second portion which cooperate with each other to retain a coil of plastic pipe. The main cage first portion comprises a center plate, a plurality of strut arms, a plurality of coil supports, with each coil support being secured to a strut arm, a plurality of gussets, with each of the gussets being secured to a coil support and also to the center plate, at least one mounting pin secured to the main cage first portion, and an exterior side wall, with each of said strut arms connected to and radiating outwardly from the center plate, and with each of the arms connected to the exterior side wall. The main cage second portion comprises a center plate, a plurality of strut arms, at least one locking plate, and an exterior side wall, with each of the strut arms connected to and radiating outwardly from the center plate. Each of the strut arms are connected to the exterior side wall, and each mounting pin cooperates with a respective locking plate to retain a coil of plastic pipe between the first and second portions, such that the mounting unit in contact with the moving vehicle as the pipe is unrolled. The hub and spindle assembly is positioned intermediate the main cage and the mounting unit, with the hub and spindle assembly comprising a hub portion and a spindle portion. The hub portion has a front wall, which front wall is in contact with the center plate. The spindle portion comprises a connecting tube and a retaining plate, with the connecting tube engaging the mounting unit. The retaining plate cooperates with the mounting unit to secure the hub and spindle assembly to the mounting unit. The mounting unit comprises a pair of opposing side walls separated by a plurality of spacing bars, a connecting channel for engaging the hub and spindle assembly, and at least one retaining plate cooperating with the hub and spindle assembly to secure the mounting unit to the hub and spindle assembly.

The primary objective of this invention is to provide a device for the dispensing of plastic pipe from a coil, which device is of relatively economical construction and is particularly easy to utilize in the laying of pipe.

Another objective of this invention is to provide a device for the dispensing of plastic pipe from a coil, which dispensing operation can take place using at most 3, and preferably only 2, workers.

Still another objective of this invention is to provide a device for the dispensing of plastic pipe from a coil, such that the pipe can be laid relatively quickly.

Other objects and advantages of the invention will be apparent from the following description, the accompanying drawings, and the appended claims.

DETAILED DESCRIPTION OF THE DRAWINGS

Figure 1:
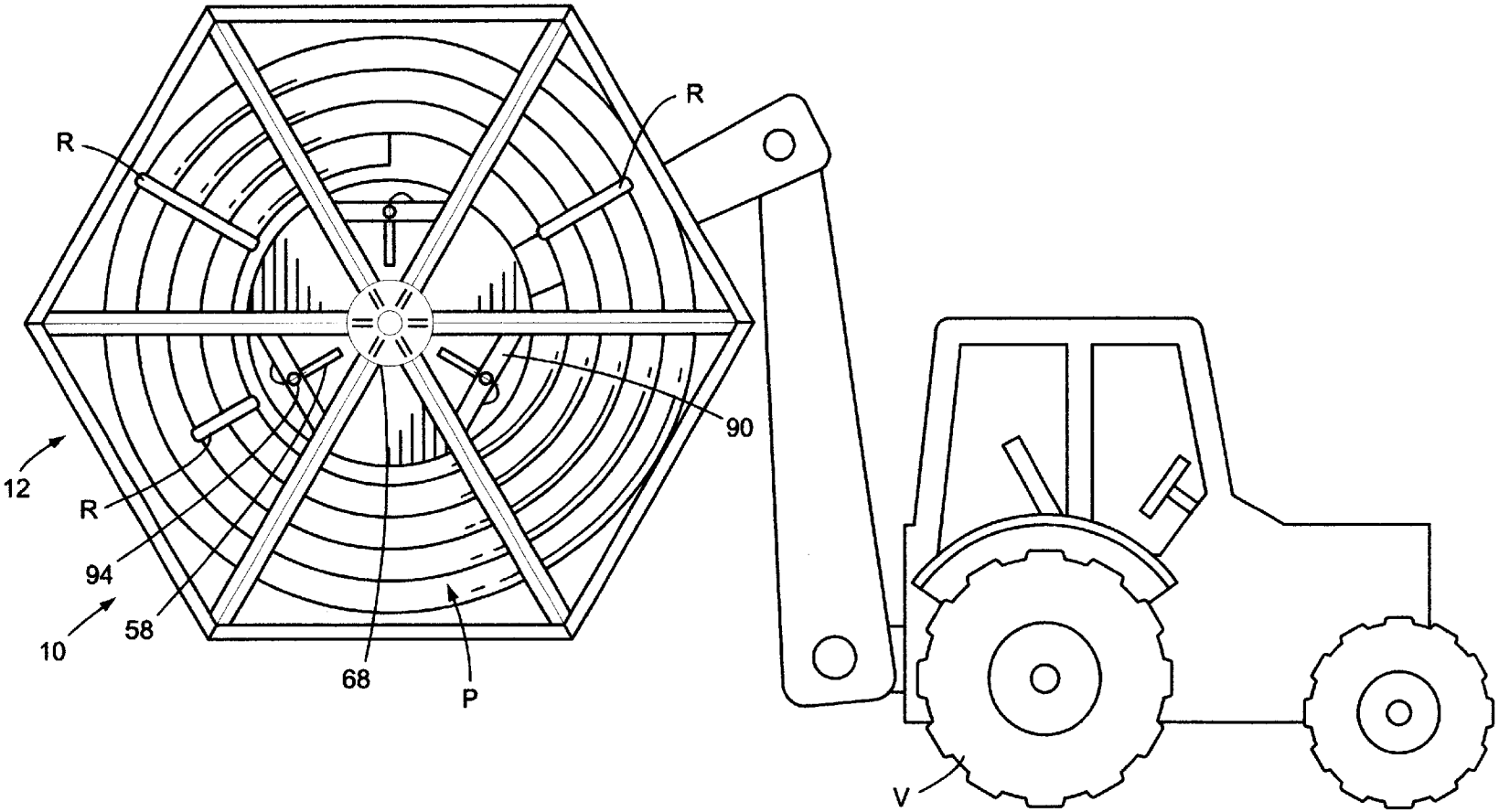
FIG. 1 is a side elevational view of a coiled pipe dispensing rack made in accordance with the present invention being used in conjunction with a back-hoe.

Having reference to the drawings, attention is directed first to FIG. 1 which discloses a coiled pipe dispensing rack made in accordance with the invention designated generally by the numeral 10. In actual use the rack is utilized along with a vehicle V to quickly and easily unroll pipe P. As will be discussed below, although the vehicle V could be a truck or tractor, excellent results have been obtained with the vehicle being a back-hoe.

As mentioned above, the coiled pipe P used in natural gas pipelines features retaining bands R which wrap the coiled pipe such that only 25' or so at a time can be dispensed from the rack. Although one of the problems associated with the cutting of these bands has been the tendency of the pipe to uncoil uncontrollably, it will be appreciated that the coil is "encased" within the rack so as to limit the extent to which it can uncoil.

Figure 2:
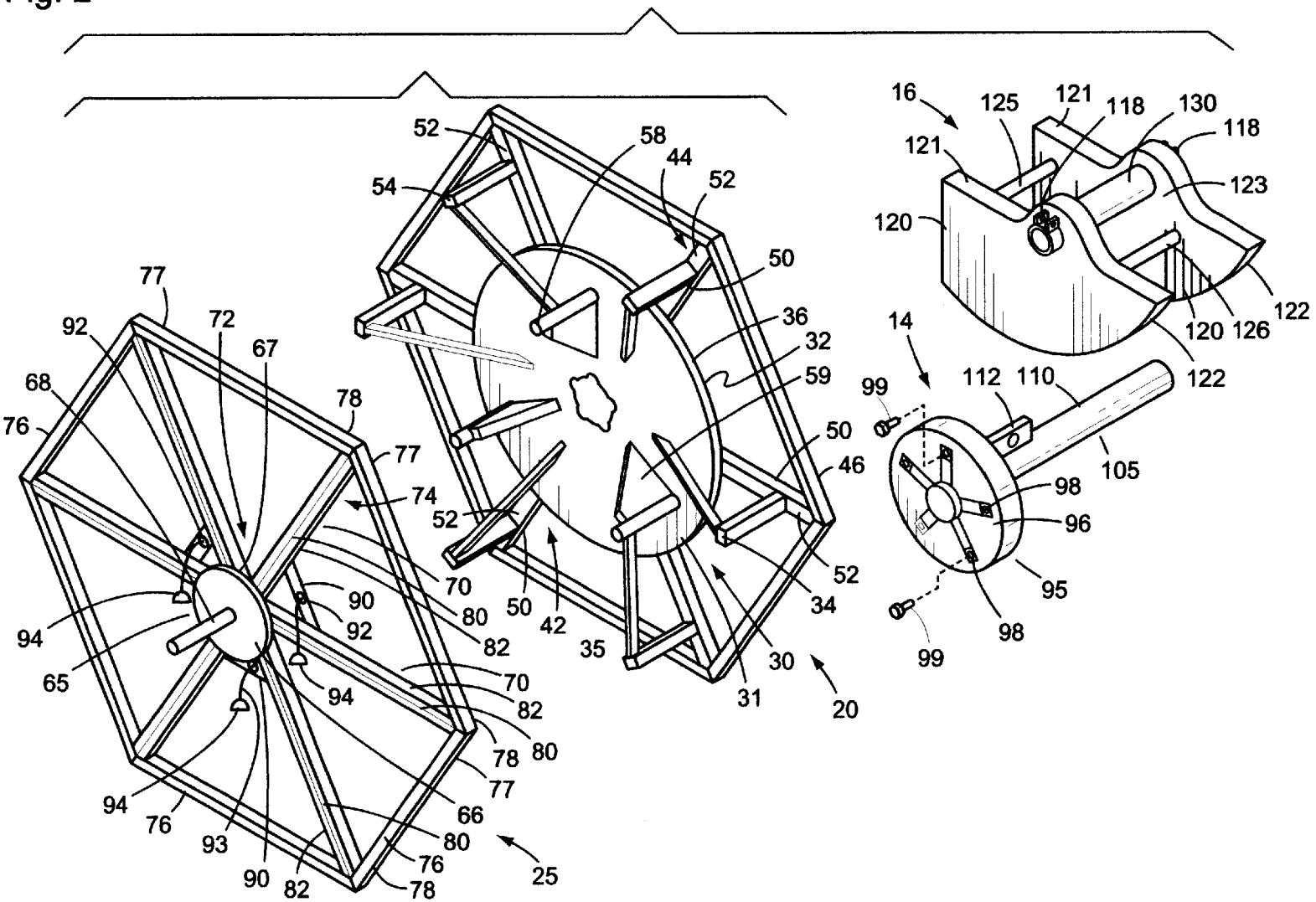
FIG. 2 is an exploded perspective view of the coiled pipe dispensing rack of this invention.
Figure 3:
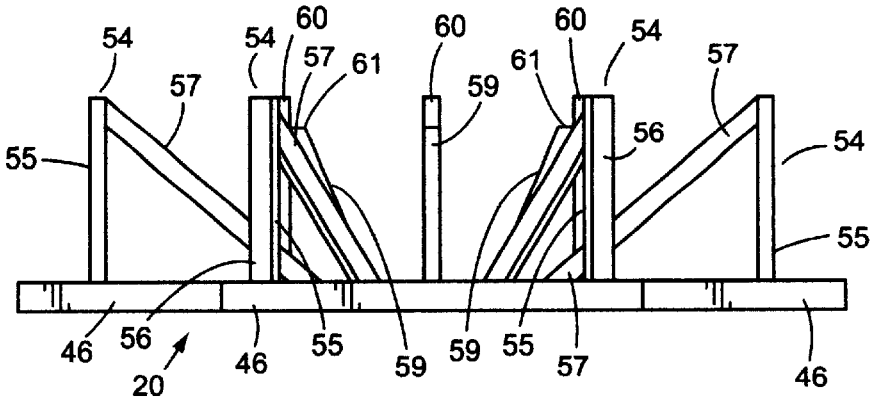
FIG. 3 is an side elevational view of the main cage portion of the invention, when the main cage is laying on the ground.
Figure 4:
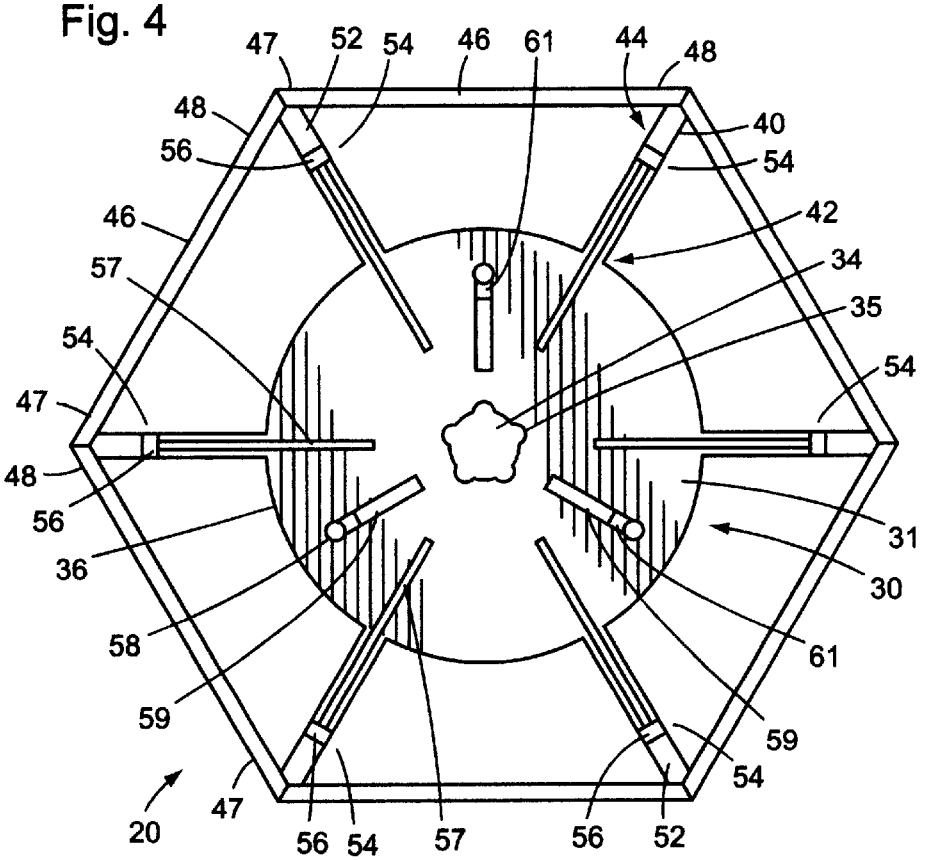
FIG. 4 is a top plan view of FIG. 3.

Turning now to a discussion of the components which make up this invention, attention is directed first to a comparison of FIGS. 2, 3, and 4. Generally, the pipe dispensing rack of the invention is comprised of a main cage 12, a hub and spindle assembly 14, and a mounting unit 16. The main cage is approximately 7' across and is comprised of a first portion 20 and a second portion 25 as can best be appreciated from FIG. 2.

A more careful consideration of the first portion 20 discloses that it is features a center plate 30. This center plate 30 has a top surface 31 and a bottom surface 32. Further, the center plate 30 has a distinctive looking center aperture 34 characterized by a plurality of slots or indentions at the periphery of the center aperture which extend outwardly into the center plate. The center plate 30 also has an outer peripheral edge 36. Structurally, the center plate is formed of ¼" thick flat steel that is 28" in diameter.

Returning now to a comparison of FIGS. 2, 3, and 4, the first portion 20 of the main cage 12 also features a plurality of strut arms 40. As shown there are six such strut arms 40, each having a first or proximal end 42 and a second or distal end 44. The proximal end 42 is adjacent to the center plate 30 to which it is welded. Meanwhile, the distal end of each strut arm 40 is welded to edge plates 46. Each edge plate 46 has a first end 47 and a second end 48. Each edge plate has its first end 47 secured to the directly adjacent edge plate's second end 48. It is at the juncture of the adjacent edge plates that each strut arm is also attached as can best be appreciated from FIGS. 2 and 4. Each strut arm 40 is formed from T-iron, such that there is an upright portion 50 and crossbar portion 52.

Another feature of the first portion 20 is the inner spool supports or coil supports 54 also formed of T-iron such that each coil support 54 has an upright portion 55 and a crossbar portion 56. In the preferred embodiment of the invention, the base of each coil support 54 is secured to the crossbar portion 52 of the corresponding strut arm 40, preferably perpendicular thereto. At the top of each coil support, a ¼" thick and ¾" wide gusset 57 is attached to the upright portion 50 and angled downwardly towards the center plate 30 where its opposite end is secured.

Still another feature of the first portion of the main cage is the at least one mounting pin 58 which is used to effectuate the securing of the first and second portions of the main cage together. In the preferred embodiment of the invention there are three such mounting pins. Each pin 58 is formed of a cylindrical rod secured to the center plate 30 so as to preferably be perpendicular thereto. Near the top of each pin is a mounting pin aperture which extends through each pin 58. Adjacent each pin is a support plate 59 having a lip 61 along its top edge as can best be seen in FIG. 3. As can be appreciated from a comparison of FIGS. 1 and 2, the second portion of the main cage rests upon the lip 61. The support plate is formed of a sheet of metal with the length of its base being greater than the length of the lip 61. The base of the support plate is secured to the center plate, with each mounting pin/support plate combination shown as preferably being closer to the center aperture 34 than the coil supports.

With respect to the second portion 25 of the main cage 12, it will be appreciated that it too has a center plate. Second portion center plate 65 has a top surface 66 and a bottom surface 67. Additionally, as can be appreciated from FIGS. 1 and 2, a short length of pipe projects from the center plate so as to form a wire spool holder 68.

The second portion 25 also has second portion strut arms 70. As shown there are six such strut arms 70, each having a first or proximal end 72 and a second or distal end 74. The proximal end 72 is adjacent to the center plate 65 to which it is welded. Meanwhile, the distal end of each strut arm 70 is welded to edge plates 76. Each second portion edge plate 76 has a first end 77 and a second end 78. Each edge plate has its first end 77 secured to the directly adjacent edge plate's second end 78. It is at the juncture of the adjacent edge plates that each strut arm is also attached as can best be appreciated from FIG. 2. Each strut arm 70 is formed from T-iron, such that there is an upright portion 80 and crossbar portion 82.

Spanning at least one pair of adjacent strut arms 70, and preferably at least three pairs as shown, are locking plates or brackets 90 made from ¼" steel plate secured at its opposing ends to adjacent strut arms. Near the center of each locking plate 90 is an aperture 92. Suitable retaining means 94, such as clips or other fastening means, are secured by connecting means 93 to each locking plate. The connecting means 93 could take the form of a chain. The mounting pin 58 is inserted through the hole in the bracket 90, and retaining means 94 is preferably inserted through the mounting pin aperture 60 to fasten the second and first portions together. It will be appreciated that strut arms 40 are in a first plane associated with the main cage first portion, and strut arms 70 are in a second plane associated with the main cage second portion, with the distance between these planes being about 15". These planes are parallel to each other and spaced apart with the coiled pipe being intermediate the planes.

Figure 5:
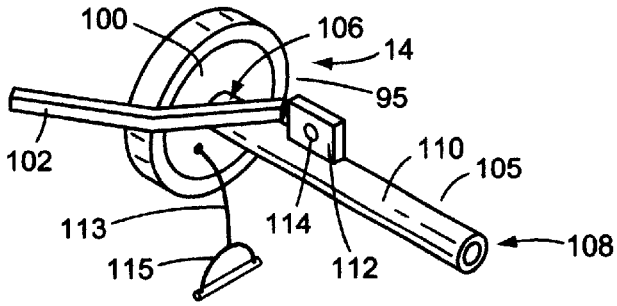
FIG. 5 is a perspective view of the hub assembly of the invention taken from the rear of FIG. 1.
Figure 6:
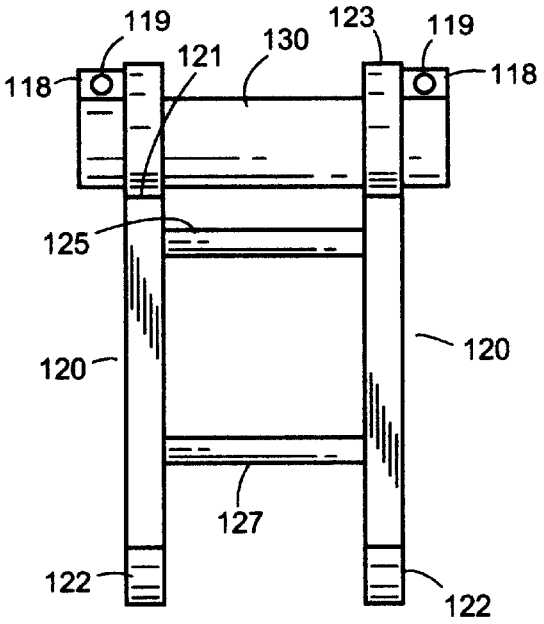
FIG. 6 is a side elevational view of the mounting unit component of the invention taken from the left side of FIG. 1.
Figure 7:
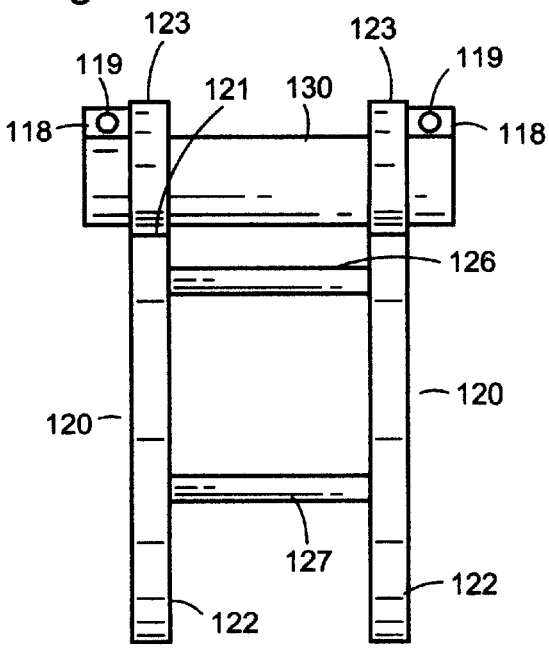
FIG. 7 is a side elevational view of the mounting unit component of the invention taken from the right side of FIG. 1.
Figure 8:
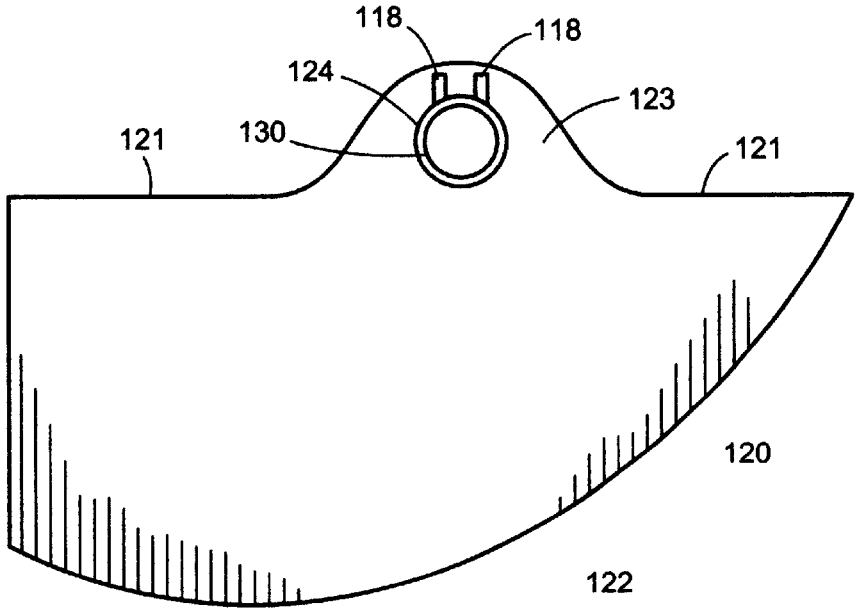
FIG. 8 is a front elevational view of the mounting unit component of the invention taken from the front of FIG. 1.

Turning now to a comparison of FIGS. 2 and 5, the hub and spindle assembly 14 is shown as including a hub portion 95 and a spindle portion 105. In reality, these two components function much like a hub and an axle. The hub portion 95 has a front wall 96 having a plurality of front wall apertures 98. Bolts 99 secure the hub portion to the center plate 30. The hub portion 95 also has a rear wall 100 to which is attached a brake mechanism 102 of the type well known in the art associated with hubs and axles. In actual use, this brake mechanism 102 can be actuated if the pipe is uncoiling too fast, and as such can be used to control the rate of dispensing.

The spindle portion 105 has a first end 106 and a second end 108. A connecting tube 110 is secured to the hub portion 95 at the first end of the spindle portion. Atop the connecting tube 110 is a retaining plate 112. This small plate has an aperture 114 formed therethrough. A connecting means, such as a chain, is used to keep suitable retaining means 115 handy. The spindle retaining means 115 could take the form of clips or other fastening means, and are secured by connecting means 113 to the hub and spindle assembly.

Turning now to a comparison of FIGS. 2, 6, 7, and 8, it will be appreciated that the mounting unit 16 is formed having two pairs of mounting unit retaining plates 118, with each of the plates having apertures 119. The reason for having two pairs of mounting unit retaining plates is so that the pipe can be dispensed from either side of the vehicle, in particular a back-hoe. The apertures in the mounting unit retaining plates 118 can be aligned with the apertures in the spindle retaining plate. When so aligned, the retaining means 115 can be inserted through the apertures to effectuate the fastening of the hub and spindle assembly to the mounting unit.

The mounting unit 16 also has a pair of side walls 120 having a planar top edge 121 and a curved bottom edge 122. The shape of the side walls is particularly important when a back-hoe is chosen as the vehicle to carry the pipe dispenser during the installation process. The curved shape of the side walls 120 enables the back-hoe to be maneuvered into a "closed" position whereby the mounting unit is held securely within the back-hoe bucket.

The mounting unit's side walls 120 also feature an elevated portion 123 having an aperture 124. The side walls themselves are separated by the presence of a plurality of spacing bars 125, 126, and 127. Extending between each of the elevated portions 123 is connecting channel 130 which in actual use has the connecting tube 110 inserted therein. The connecting channel is formed from 1¼" diameter pipe, while each of the side walls of the mounting unit is formed from ⅜" thick steel plate.

In actual use, the device is formed by placing the mounting unit in a vehicle, such as the bucket of a back-hoe. The hub and spindle assembly can then be secured to the mounting unit. Then the first portion is bolted to the hub portion. The pipe to be installed is then laid onto the strut arms of the first portion such that the inside of the coil is adjacent the coil supports 54. The second portion is then aligned adjacent the first portion such that at least one mounting pin 58 can be secured to locking plate 90.

In actual pipe installation, the coiled pipe dispensing rack of this invention can unroll hundreds of feet of pipe in a fraction of the time previously needed to accomplish the job manually. Moreover, this can be accomplished using fewer workers and at a lower risk of injury. As the pipe is unrolled, a coil of wire which has been placed over the wire spool holder permits a wire to be unrolled contemporaneously with the pipe, since in practice a metallic substance is laid in the trench with the pipe to permit the location of the plastic pipe to be detected from above ground in case service is needed, and the presence of the wire facilitates the use of a conventional metal detector.

Therefore, not only is the coiled pipe dispensing rack of this invention relatively easy to fabricate, but it is also very easy to utilize. Consequently, the invention results in a considerable reduction in labor as well as time and installation expense.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A coiled pipe dispensing rack for use in cooperation with a moving vehicle to effectuate the unrolling of plastic pipe, said rack comprising a main cage, a hub and spindle assembly, and a mounting unit, said main cage comprising a first portion and a second portion which cooperate with each other to retain a coil of plastic pipe, said main cage first portion comprising a center plate, a plurality of strut arms, and an exterior side wall, each of said strut arms connected to and radiating outwardly from said center plate, each of said strut arms connected to said exterior side wall, said mounting unit in contact with the moving vehicle as the pipe is unrolled, said hub and spindle assembly positioned intermediate said main cage and said mounting unit.

2. The device according to claim 1 which includes a plurality of coil supports, each coil support being secured to a strut arm.

3. The device according to claim 2 which includes a plurality of gussets, each of said gussets being secured to a coil support and also to said center plate.

4. The device according to claim 1 which includes at least one mounting pin secured to said main cage first portion.

5. The device according to claim 1 wherein said main cage second portion comprises a center plate, a plurality of strut arms, at least one locking plate, and an exterior side wall, each of said strut arms connected to and radiating outwardly from said center plate, each of said strut arms connected to said exterior side wall.

6. The device according to claim 5 which includes at least one mounting pin secured to said main cage first portion, each said mounting pin cooperating with a respective locking plate to retain a coil of plastic pipe between said first and second portions.

7. The device according to claim 1 wherein said hub and spindle assembly comprises a hub portion and a spindle portion, said hub portion having a front wall, said front wall being in contact with said center plate, said spindle portion comprising a connecting tube and a retaining plate, said connecting tube engaging said mounting unit, said retaining plate cooperating with said mounting unit to secure said hub and spindle assembly to said mounting unit.

8. The device according to claim 1 wherein said mounting unit comprises a pair of opposing side walls separated by a plurality of spacing bars, a connecting channel to engage said hub and spindle assembly, and at least one retaining plate cooperating with said hub and spindle assembly to secure said mounting unit to said hub and spindle assembly.

9. The device according to claim 1 wherein said main cage first portion comprises a plurality of strut arms having associated therewith a first plane, and wherein said main cage second portion comprises a plurality of strut arms having associated therewith a second plane, said planes being parallel to each other and spaced apart with coiled pipe being intermediate said planes.

10. A coiled pipe dispensing rack for use in cooperation with a moving vehicle to effectuate the unrolling of plastic pipe, said rack comprising a main cage, a hub and spindle assembly, and a mounting unit, said main cage comprising a first portion and a second portion which cooperate with each other to retain a coil of plastic pipe, said main cage second portion comprising a center plate, a plurality of strut arms, at least one locking plate, and an exterior side wall, each of said strut arms connected to and radiating outwardly from said center plate, each of said strut arms connected to said exterior side wall, said mounting unit in contact with the moving vehicle as the pipe is unrolled, said hub and spindle assembly positioned intermediate said main cage and said mounting unit.

11. The device according to claim 10 which includes at least one mounting pin secured to said main cage first portion, each said mounting pin cooperating with a respective locking plate to retain a coil of plastic pipe between said first and second portions.

12. The device according to claim 10 wherein said mounting unit comprises a pair of opposing side walls separated by a plurality of spacing bars, a connecting channel to engage said hub and spindle assembly, and at least one retaining plate cooperating with said hub and spindle assembly to secure said mounting unit to said hub and spindle assembly.

13. The device according to claim 10 wherein said main cage first portion comprises a plurality of strut arms having associated therewith a first plane, and said main cage second portion comprises a plurality of strut arms having associated therewith a second plane, said planes being parallel to each other and spaced apart with coiled pipe being intermediate said planes.

14. A coiled pipe dispensing rack for use in cooperation with a moving vehicle to effectuate the unrolling of plastic pipe, said rack comprising a main cage, a hub and spindle assembly, and a mounting unit, said main cage comprising a first portion and a second portion which cooperate with each other to retain a coil of plastic pipe, said mounting unit comprising a pair of opposing side walls separated by a plurality of spacing bars, a connecting channel to engage said hub and spindle assembly, and at least one retaining plate cooperating with said hub and spindle assembly to secure said mounting unit to said hub and spindle assembly, said mounting unit in contact with the moving vehicle as the pipe is unrolled, said hub and spindle assembly positioned intermediate said main cage and said mounting unit.

15. A coiled pipe dispensing rack for use in cooperation with a moving vehicle to effectuate the unrolling of plastic pipe, said rack comprising a main cage, a hub and spindle assembly, and a mounting unit, said main cage comprising a first portion and a second portion which cooperate with each other to retain a coil of plastic pipe, said main cage first portion comprising a plurality of strut arms having associated therewith a first plane, said main cage second portion comprising a plurality of strut arms having associated therewith a second plane, said planes being parallel to each other and spaced apart with coiled pipe being intermediate said planes, said mounting unit in contact with the moving vehicle as the pipe is unrolled, said hub and spindle assembly positioned intermediate said main cage and said mounting unit.

* * * * *